US005237831A

United States Patent [19]

Sikora

[11] Patent Number: 5,237,831

[45] Date of Patent: Aug. 24, 1993

[54] AIR CONDITIONING APPARATUS

[75] Inventor: Paul Sikora, County Cork, Ireland

[73] Assignee: EOLAS, Dublin, Ireland

[21] Appl. No.: 766,918

[22] Filed: Sep. 27, 1991

Related U.S. Application Data

[63] Continuation of Ser. No. 594,981, Oct. 10, 1990, abandoned.

[30] Foreign Application Priority Data

Oct. 11, 1989 [IE] Ireland ..... 3273/89

[51] Int. Cl.[5] ..... F25B 29/00

[52] U.S. Cl. ..... 62/159; 62/173; 62/160; 165/86

[58] Field of Search ..... 62/263, 159, 160, 324.1, 62/325, 173, 90; 165/86, 96; 251/901

[56] References Cited

U.S. PATENT DOCUMENTS

| | | | |
|---|---|---|---|
| 2,147,283 | 2/1939 | Covell | 165/86 X |
| 2,286,605 | 3/1939 | Crawford | 62/173 |
| 2,481,348 | 9/1949 | Ringquist et al. | 62/160 X |
| 2,729,072 | 1/1956 | Dybvig | 62/325 |
| 3,143,864 | 8/1964 | Schordine | 62/159 X |
| 3,631,686 | 1/1972 | Kautz | 62/173 |
| 4,018,268 | 4/1977 | Kallies | 165/86 |
| 4,621,683 | 11/1986 | Knab | 165/86 |
| 4,788,903 | 12/1988 | Johnson | 98/2.18 X |

FOREIGN PATENT DOCUMENTS

| | | | |
|---|---|---|---|
| 2256149 | 5/1974 | Fed. Rep. of Germany | 251/901 |
| 2342466 | 9/1977 | France | 62/325 |

*Primary Examiner*—John M. Sollecito

*Attorney, Agent, or Firm*—Burns, Doane, Swecker & Mathis

[57] ABSTRACT

An air conditioning apparatus (1) is disclosed which includes a pair of adjacent parallel air ducts, namely a conditioned air duct (4) and an ambient air duct (5), wherein the ducts (4,5) have a common side wall (7). A fan (14) delivers an air stream through the conditioned air duct (4) to condition the air stream. A fan 15 delivers ambient air through the ambient air duct (5). Mounted within the ambient air duct (5) is a refrigeration unit having a condenser (20) and an evaporator (21). The condenser (20) and evaporator (21) are slidable between the two ducts (4,5) along tracks (43,46) extending through openings (25,26) in the side wall (7) to condition air passed through the conditioned air duct (4) to a pre-set desired condition.

11 Claims, 7 Drawing Sheets

AIR CONDITIONING APPARATUS

This application is a continuation, of application Ser. No. 07/594,981, filed Oct. 10, 1990 now abandoned.

BACKGROUND OF THE INVENTION

1. Field of the Invention

This invention relates to an air conditioning apparatus.

2. Description of the Related Art

Equipment for the thermal conditioning of air usually includes a mechanical refrigeration apparatus to transfer heat between a conditioned air stream and a thermal reservoir, for example, ambient air. The refrigeration apparatus will include two heat exchangers, one acting as an evaporator and the other as a condenser for refrigerant circulated in the refrigeration apparatus. By locating one heat exchanger in the conditioned air stream and incorporating a reverse cycle control in the refrigeration apparatus it is possible to provide heating or cooling to the conditioned air stream. For heating the heat exchanger acts as a condenser and for cooling it acts as an evaporator. Alternatively, the refrigeration apparatus may provide dehumidification by placing both heat exchangers in the conditioned air stream such that the conditioned air stream is cooled at the first heat exchanger (evaporator) and then heated at the second heat exchanger (condenser).

In order to make possible all three thermal air conditioning functions, that is heating, cooling and dehumidification it is necessary either to provide means for directing the conditioned air stream through the desired heat exchanger individually for heating or cooling and through both heat exchangers for dehumidification. Alternatively it is possible to provide a refrigeration apparatus having a reverse cycle together with a supplementary heating element for use during dehumidification. The first approach requires extensive air flow control equipment and makes the unit physically larger in size. The latter approach maintains a simple air handling system but it must include some means of re-heating the conditioned air stream when dehumidification is required, for example by way of a supplementary heating element. A further disadvantage of the latter approach is its energy inefficiency, wherein heat is rejected to the outside air stream while additional heat must be produced to reheat the conditioned air stream.

The present invention is directed towards providing an improved air conditioning apparatus which overcomes these problems.

SUMMARY OF THE INVENTION

According to the invention there is provided an air conditioning apparatus comprising a pair of heat exchangers, namely a heater and a cooler, and means for mounting the heat exchangers adjacent an air stream path for movement into and out of an air stream path to condition an air stream delivered along the path. This advantageously provides an air conditioning apparatus of relatively simple construction which can be operated to heat, cool or dehumidify an air stream as required.

In one embodiment of the invention, the heater is a condenser and the cooler is an evaporator of a refrigeration system. Advantageously during dehumidification some or all of the heat extracted by the evaporator from the air stream to condense water out of the air stream is returned to the air stream by the condenser.

In another embodiment each heat exchanger is movable between a withdrawn position out of the air stream path through a partially inserted intermediate position extending partially across the air stream path and a fully inserted position extending substantially fully across the air stream path. This advantageously allows the heat transfer surface area of the heat exchangers located within the air stream path to be adjusted.

In another embodiment each heat exchanger is movable transversely to the direction of air flow along the air stream path.

In a further embodiment the air stream path is defined by a conditioned air duct, the conditioned air duct having a side wall with openings, the heat exchangers being movable through the openings into and out of the air stream path.

In another embodiment each heat exchanger is slidable into and out of the air stream path. Preferably the mounting means has tracks for the heat exchangers, each heat exchanger being slidable into and out of the air stream path along a track.

In a particularly preferred embodiment drive means is provided to move the heat exchangers along the tracks. Preferably, control means is provided for operation of the drive means, the control means having sensors mounted in the air stream path downstream of the heat exchangers to sense air condition, and actuating means to operate the drive means in response to sensed air condition to position the heat exchangers in the air stream path to maintain air delivered through the air stream path at a pre-set desired condition.

In a further embodiment an air flow baffle is provided for each heat exchanger, the baffle being extendable within the air stream path between the heat exchanger and a side wall of the air stream path to regulate air flow along the air stream path. The baffle may be fixed to the heat exchanger and the side wall. Alternatively, the baffle may be mounted on either the heat exchanger or the side wall. Preferably, the baffle and the heat exchanger have a substantially similar air flow resistance to promote an even air flow along the air stream path in use. This advantageously maintains the total air flow through the conditioned air duct substantially constant regardless of the positions of the heat exchangers. It also advantageously ensures that the quantity of air which passes through each heat exchanger is directly proportional to the part of the heat exchanger which is in the conditioned air duct. This arrangement results in a more accurately proportional operation of the air conditioning process.

In a preferred embodiment the baffle is a flexible sheet wound on a rotationally biased roller, the sheet extendable from the roller against roller bias between the heat exchanger and the side wall of the air stream path.

In another embodiment the baffle is a sheet of elastic material fixed to the heat exchanger and to the side wall. In an alternative arrangement the baffle has a collapsible concertina-like construction.

In a further embodiment means is provided to deliver an air flow over at least portions of the heat exchangers outside the air stream path. Preferably the means comprises a housing to receive the heat exchangers, the housing having an air inlet, an air outlet, and a fan.

In another embodiment each heat exchanger has a number of spaced-apart heat transfer fins, at least some of the fins forming closure members for the openings in the duct side wall when the fins are located in the openings. The fins thus advantageously seal the openings for all positions of the heat exchangers in the duct.

In a particularly preferred embodiment the housing is formed by an ambient air duct mounted alongside and parallel to the conditioned air duct on a support frame, the ducts being separated by a common side wall, each duct having an air inlet, an air outlet and a fan, a refrigeration unit mounted in the ambient air duct having a condenser and an evaporator which are movable between the ducts, the side wall having openings for through passage of the condenser and evaporator for movement of the evaporator and condenser between the two ducts.

In another embodiment the apparatus comprises a housing with means for mounting the housing adjacent an air stream path, the housing having an air inlet, an air outlet and a fan, a refrigeration unit mounted within the housing and having a condenser and an evaporator, the housing having a side wall with openings, the condenser and evaporator being movably mounted within the housing adjacent the openings for movement through the openings into and out of the housing.

BRIEF DESCRIPTION OF THE DRAWINGS

The invention will be more clearly understood from the following description of some embodiments thereof given by way of example only with reference to the accompanying drawings, in which.

DETAILED DESCRIPTION OF THE PREFERRED EMBODIMENTS

Figure 1:
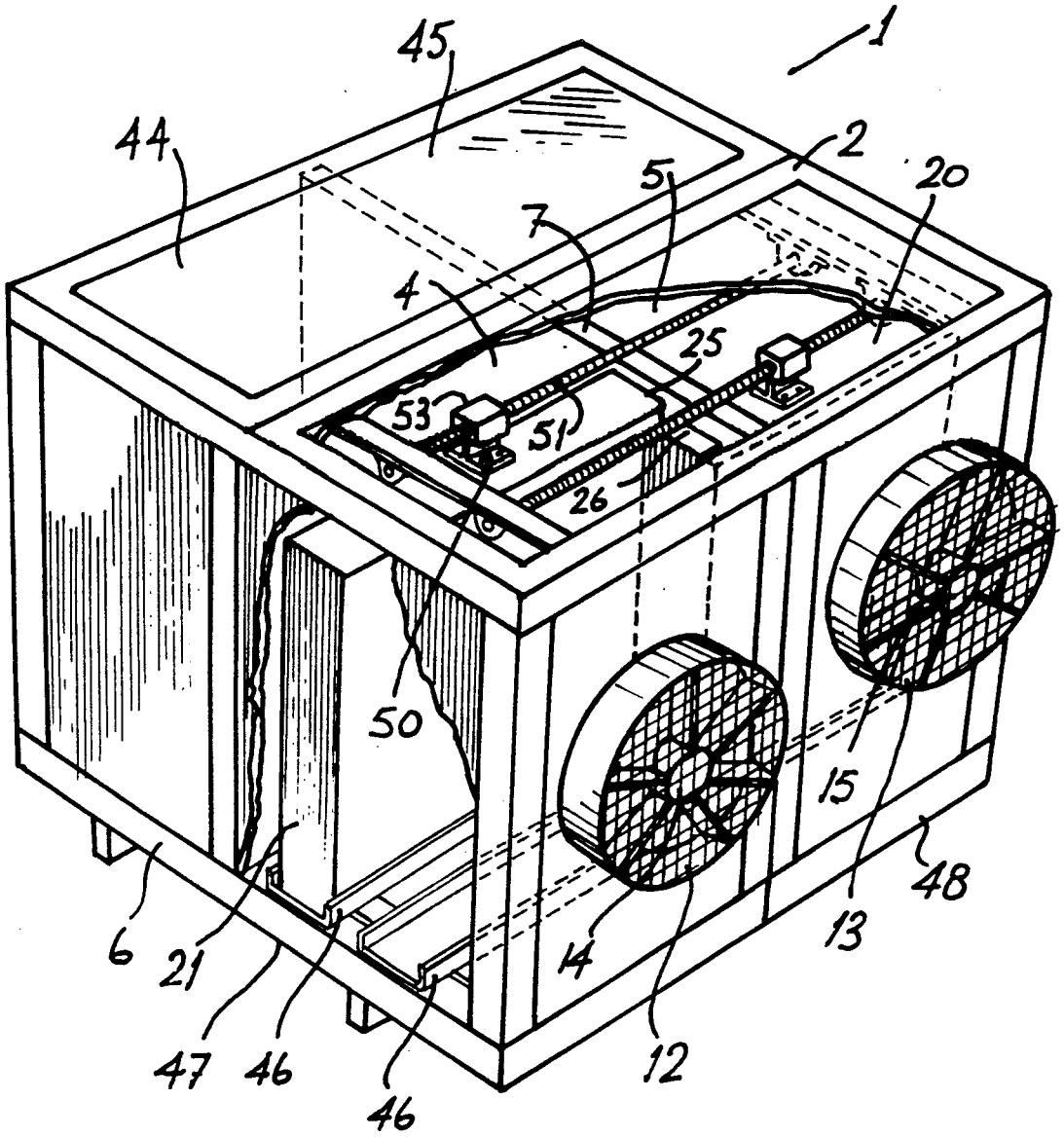
FIG. 1 is a diagrammatic perspective view of an air conditioning apparatus according to a first embodiment of the invention.
Figure 2:
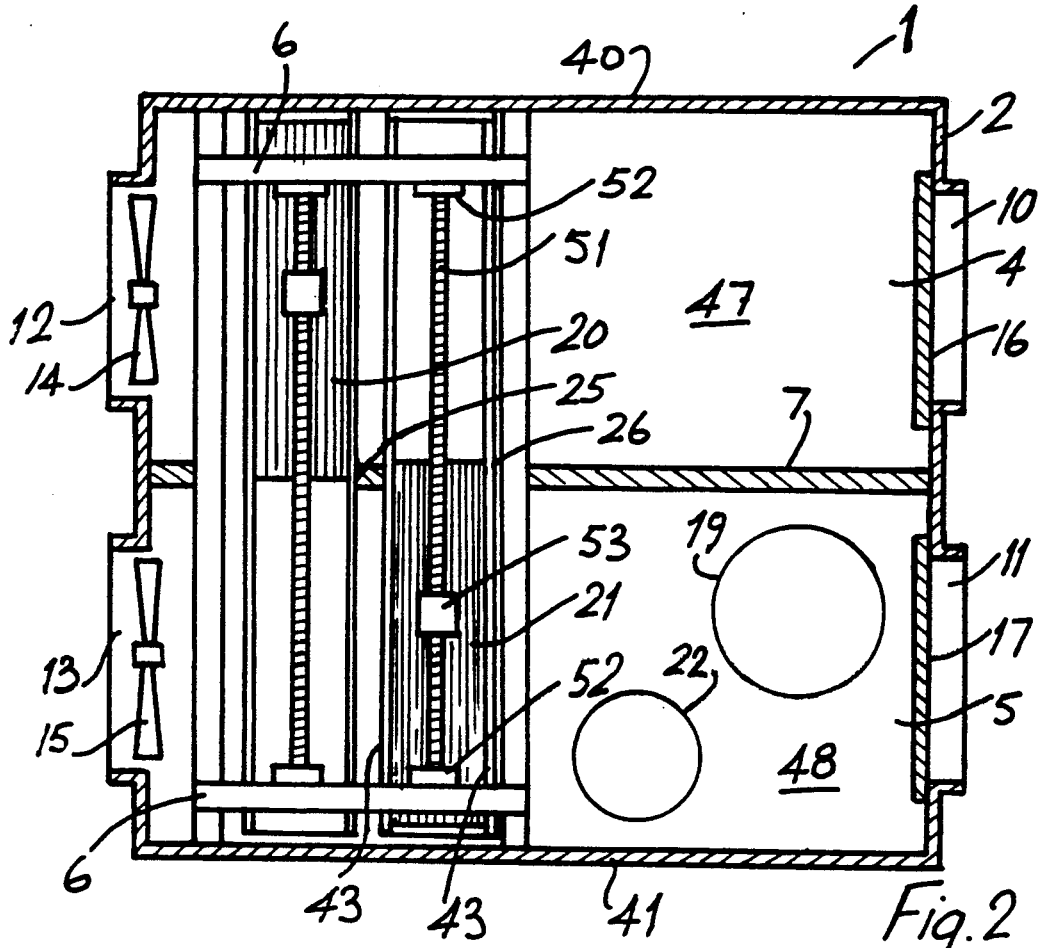
FIG. 2 is a diagrammatic plan sectional view of the apparatus of FIG. 1.
Figure 3:
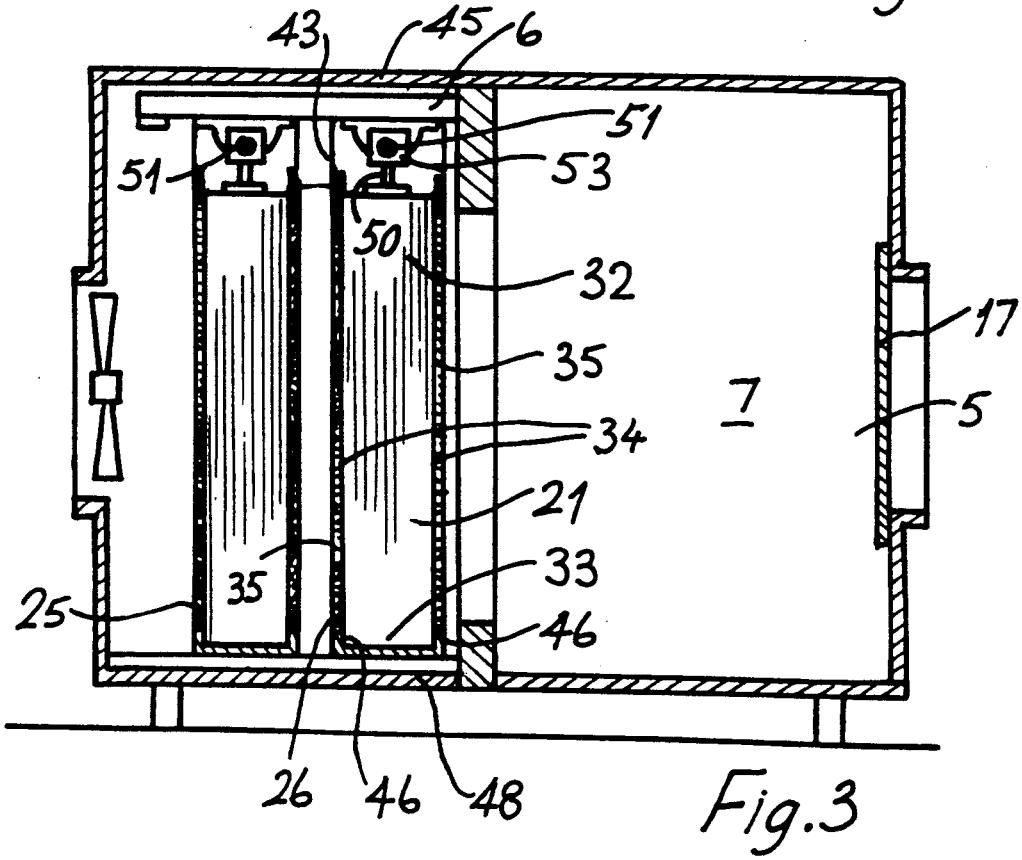
FIG. 3 is a diagrammatic side sectional view of the apparatus of FIG. 1.
Figure 4:
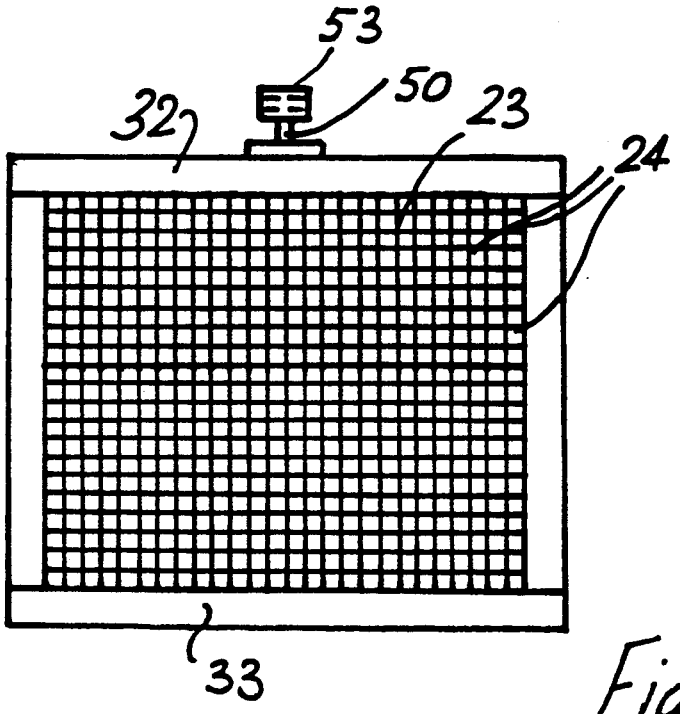
FIG. 4 is an elevational view of a heat exchanger forming portion of the apparatus of FIG. 1.
Figure 5:
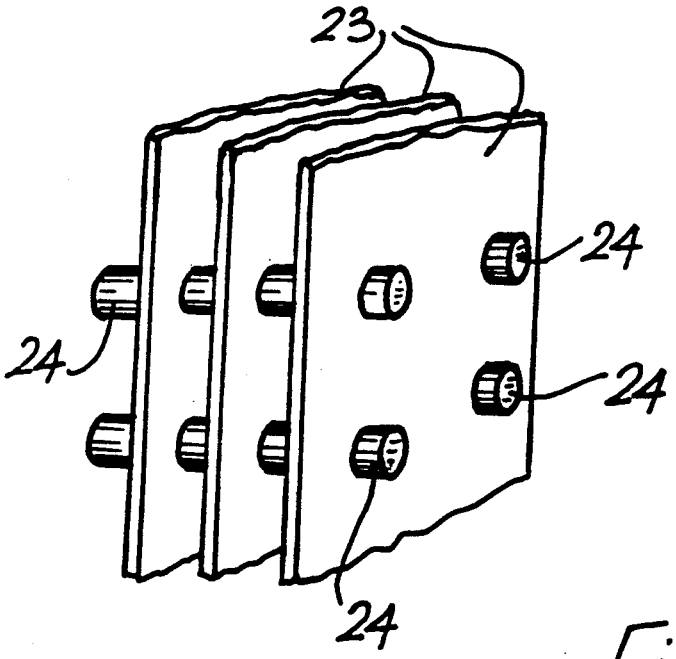
FIG. 5 is a detail perspective cut-away view of portion of the heat exchanger of FIG. 4, FIG. 6 to FIG. 9 inclusive are diagrammatic sectional plan views of the apparatus of FIG. 1 illustrating various arrangements of heat exchangers within the apparatus, in use.

Referring to the drawings, and initially to FIGS. 1 to 9 thereof; there is illustrated an air conditioning apparatus according to the invention, indicated generally by the reference numeral 1. The apparatus 1 comprises a pair of parallel adjacent ducts, namely a conditioned air duct 4 defining an air stream path for conditioning air, and an ambient air duct 5, both ducts 4, 5 being mounted on a support frame 6 and the ducts 4, 5 having a common side wall 7. Each duct 4, 5 has an air inlet 10, 11 and an air outlet 12, 13 respectively. Fans 14, 15 are mounted at each outlet 12, 13. Air filters 16, 17 are mounted at each air inlet 10, 11. A refrigeration unit is located within the ambient air duct 5 and includes a compressor 19, a condenser 20, an evaporator 21 and a liquid refrigerant receiver 22. It will be noted that the condenser 20 forms a heater and the evaporator 21 forms a cooler for the air conditioning apparatus 1. Both the condenser 20 and evaporator 21 are independently movable between the two ducts 4, 5 through openings 25, 26, respectively in the side wall 7. Flexible pipes for refrigerant interconnect the condenser 20 and evaporator 21 with each other and with the remainder of the refrigerant unit which is fixed in the ambient air duct 5. The condenser 20 and evaporator 21 are both similar heat exchangers. As the construction and mounting arrangement of the evaporator 21 and condenser 20 are the same this is described below for the evaporator 21 only. A number of parallel spaced-apart vertical heat exchange fins 23 are arranged on substantially horizontal tubes 24 of the evaporator 21, the fins 23 extending between a top 32, and a bottom 33 and between front and rear sides 34 of the evaporator 21. These fins 23 are a similar shape to the opening 26 and fit through the opening 26 with a narrow clearance thus forming a closure member for the opening 26. Resilient seals 35 mounted at a periphery of the opening 26 extend inwardly to engage front and rear edges of the fins 23. This ensures isolation of air streams delivered through each duct 4, 5 in use.

The evaporator 21 is slidable along a track extending between outer side walls 40, 41 of the ducts 4, 5 through the opening 26. The track is formed by a pair of spaced-apart parallel guide plates 43 depending from the frame 6 at upper ends 44, 45 of the ducts 4, 5 to project downwardly over the front and rear sides 34 of the evaporator 21 at the top 32 of the evaporator 21 and a similar associated pair of guide plates 46 project upwardly from the frame 6 at lower ends 47, 48 of the ducts 4, 5 over the front and rear sides 34 of the evaporator 21 at the bottom 33 of the evaporator 21. A mounting bracket 50 is fixed to the top 32 of the evaporator 21. A threaded support bar 51 is rotatably mounted in bearings 52 between the sides 40, 41 of the housing 2 above the evaporator 21 and engages a threaded nut 53 fixed on the mounting bracket 50. An electric motor (not shown) with an associated reduction gear-box is mounted on the frame 6 and drivably connected to one end of the support bar 51. Control means for operation of the drive means is provided. The control means uses conventional equipment which will be readily appreciated by those skilled in the art and therefore is only briefly described below and not shown in the drawings. The control means comprises sensors to detect air temperature and air humidity, the sensors being mounted in the conditioned air duct 4 downstream of the condenser 20. Signals from the sensors go to a microcomputer which compares the sensed air condition with a pre-set desired air condition. The microcomputer controls operation of the refrigeration unit and the electric motors for positioning the condenser 20 and the evaporator 21 within the conditioned air duct 4 to maintain the pre-set desired air condition at the outlet of the conditioned air duct 4.

In use, the fans 12, 13 are operated to deliver a conditioned air stream through the conditioned air duct 4 and an ambient air stream through the ambient air duct 5 respectively. An air delivery conduit (not shown) attached at the outlet 12 of the conditioned air duct 4 directs conditioned air to, for example, a room within which the air is to be conditioned and a return air conduit (not shown) connects the room to the inlet 10 of the conditioned air duct 4. The inlet 10 is also preferably connected to a fresh air supply. The inlet 11 and outlet 13 of the ambient air duct 5 are open to ambient air.

Figure 6:
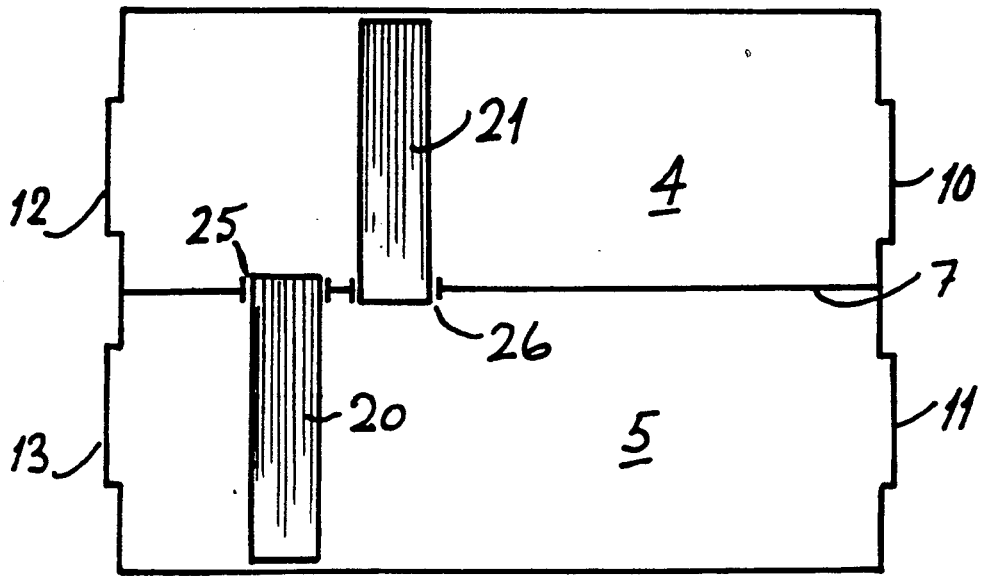

Cooling of the conditioned air stream is achieved by positioning the evaporator 21 in the conditioned air duct 4 and the condenser 20 in the ambient air duct 5 as shown in FIG. 6. As the conditioned air passes through the evaporator 21, it is cooled to the required temperature.

Figure 7:
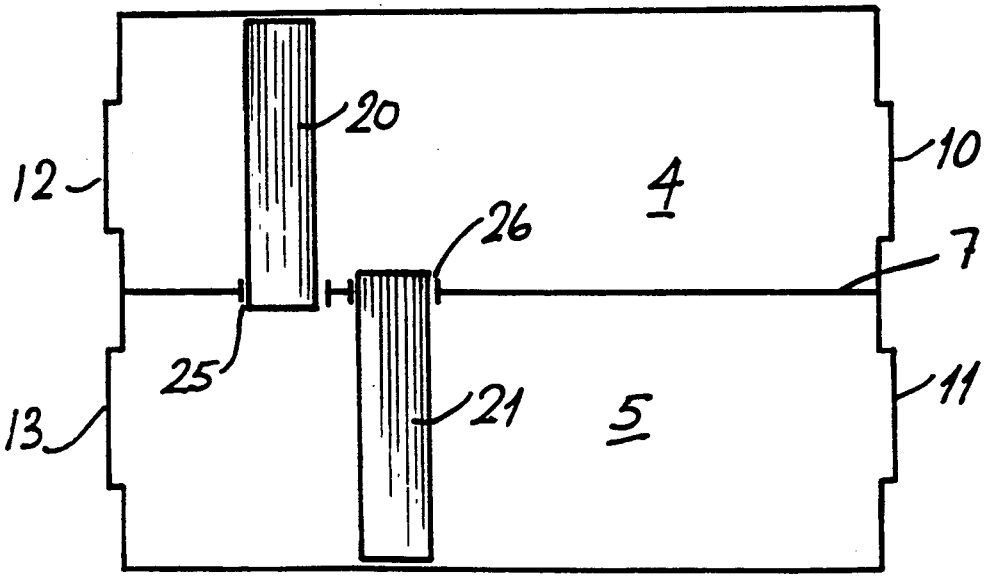

Heating the conditioned air stream is effected by locating the condenser 20 within the conditioned air duct 4 and the evaporator 21 within the ambient air duct 5 as shown in FIG. 7. In this case the conditioned air stream passing through the condenser 20 is heated to the required temperature.

Figure 8:
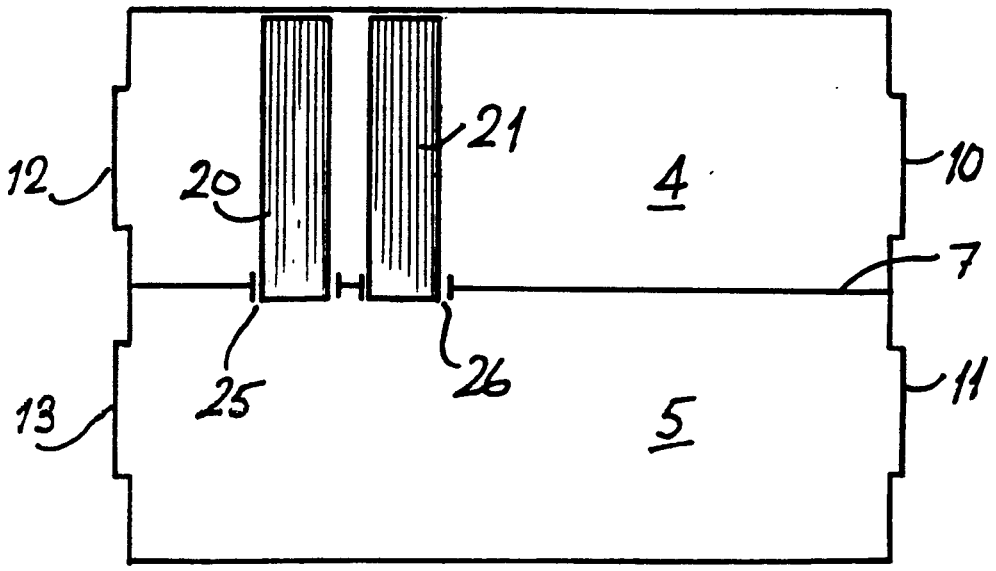

Dehumidification of the conditioned air stream is achieved by having both the evaporator 21 and condenser 20 in the conditioned air duct 4 as shown in FIG. 8. Air passing through the evaporator 21 is cooled, this cooling releasing water from the air which is collected in a water tray (not shown) beneath the evaporator 21. The conditioned air stream is subsequently heated to the required temperature by passing it through the condenser 20. Advantageously, a portion or all of the heat extracted from the air as it passes through the evaporator 21 is used to heat the air as it passes through the condenser 20.

Figure 9:
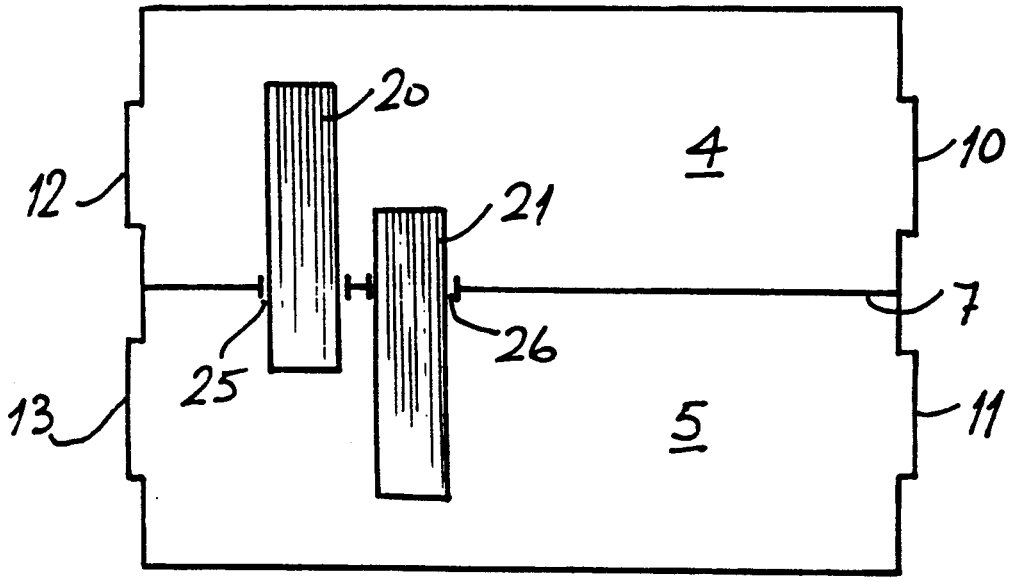

By adjusting the portions of the condenser 20 and evaporator 21 located within the conditioned air duct 4 the amount of heating, cooling and dehumidification can be continuously controlled within the desired parameters. FIG. 9 shows both the evaporator 21 and condenser 20 partially within the conditioned air duct 4. It will be appreciated that the transition from one mode, i.e. heating/cooling/dehumidification to another is continuous and this makes the unit suitable for maintaining fine control over air conditioning parameters.

It will be appreciated that in some cases the condenser and evaporator of the refrigeration system may not be used directly as the heater and cooler respectively of the air conditioning apparatus, but rather secondary heating and cooling circuits are provided. These secondary heating and cooling circuits have a movable heater and cooler respectively mounted on the conditioned air duct. A water or water/glycol mixture for example is circulated between the condenser and heater, and between the evaporator and cooler, for heat transfer between conditioned air in the duct and the refrigeration system. It will also be appreciated that the invention enables the refrigeration apparatus to be designed and operated without the compromises required to achieve reverse cycle operation. As the invention uses a simple refrigeration unit it is thus relatively cheap to produce and more reliable in operation.

It will be appreciated that movement of the condenser and evaporator may be achieved either manually or automatically in response to signals from an automatic control unit.

Figure 10:
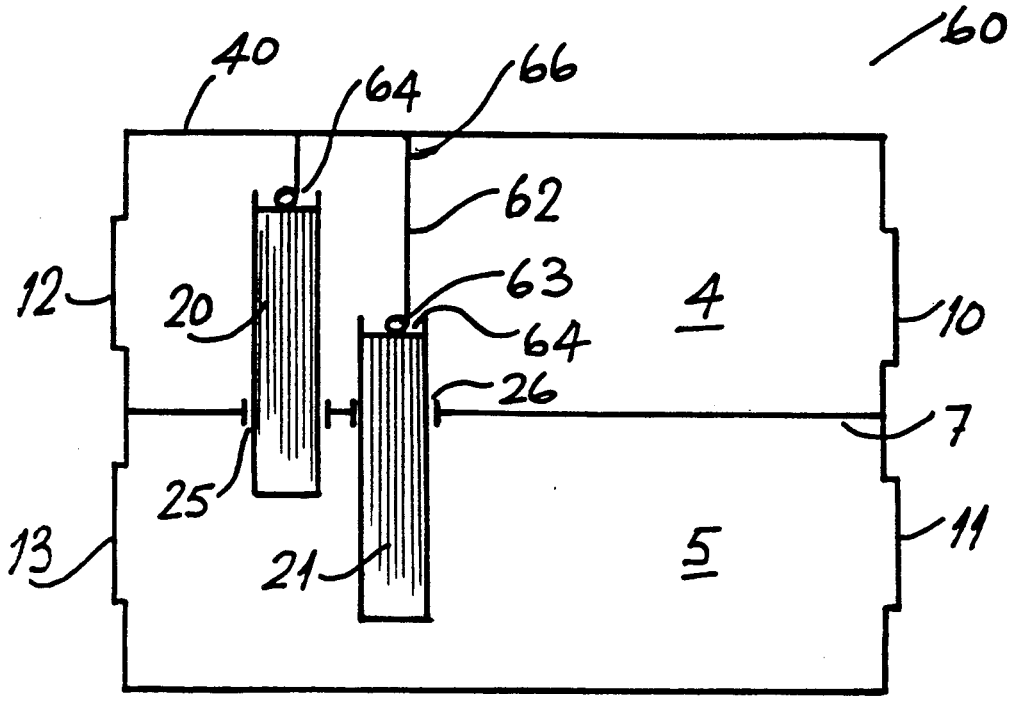
FIG. 10 is a view similar to FIG. 9 of an air conditioning apparatus according to a second embodiment of the present invention.

Referring now to FIG. 10 there is illustrated an air conditioning apparatus 60 according to a second embodiment of the present invention. This apparatus 60 is largely similar to the apparatus described previously with reference to FIGS. 1 to 9 and like parts are assigned the same reference numerals. In this case air flow baffles are provided for the evaporator 21 and condenser 20. The baffle for the evaporator 21 comprises a porous flexible sheet 62 wound on a rotationally biased roller 63 mounted along an outer edge 64 of the evaporator 21 and extending between a top 32 and bottom 33 of the evaporator 21. An outer end 66 of the sheet 62 is fixed along the outer side wall 40 of the conditioned air duct 4 between an upper end 44 and a lower end 47 of the conditioned air duct 4. The baffle on the condenser 20 is a similar arrangement to that on the evaporator 21. In use as the evaporator 21 or condenser 20 is retracted into the ambient air duct 5 the sheet 62 unrolls from the roller 63 against spring bias. As the evaporator 21 or condenser 20 is moved into the conditioned air duct 4 the roller 63 automatically winds up the sheet 62. It will be noted that the air flow resistance of the sheet 62 is similar to that of the heat exchanger to which it is attached. This advantageously maintains the total air flow through the conditioned air duct substantially constant regardless of the positions of the heat exchangers. It also advantageously ensures that the quantity of air which passes through each heat exchanger is directly proportional to the part of the heat exchanger which is in the conditioned air duct. This arrangement results in a more accurately proportional operation of the air conditioning process.

In some cases it is envisaged that similar baffles would be mounted on inner edges of the heat exchangers and extending between the heat exchangers and the outer side wall 41 of the ambient air duct 5.

Figure 11:
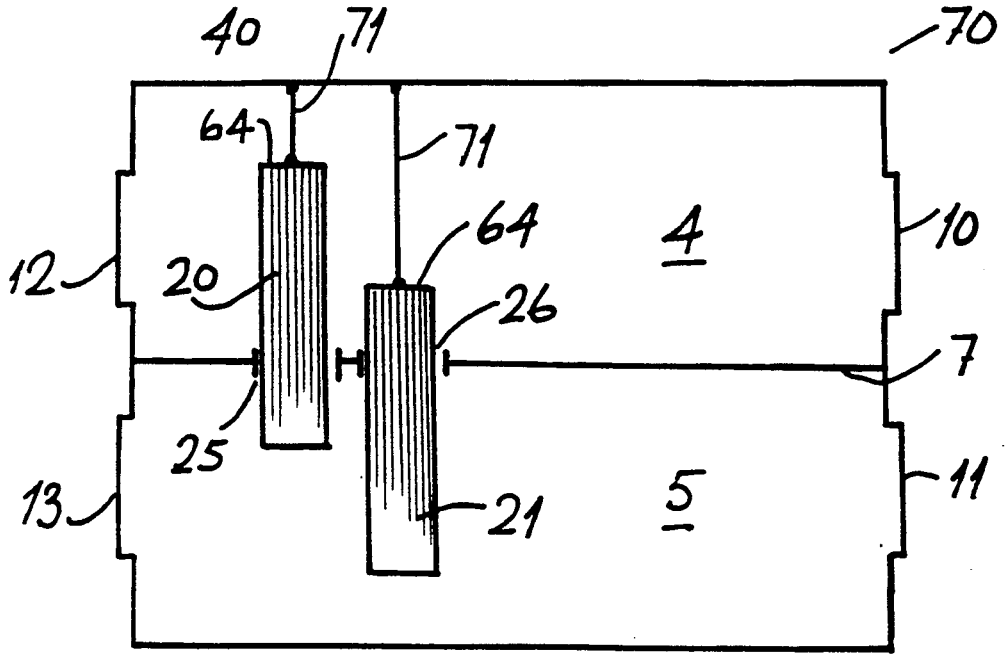
FIG. 11 is a view similar to FIG. 9 of a an air conditioning apparatus according to a third embodiment of the present invention.

Referring now to FIG. 11 there is illustrated an air conditioning apparatus 70 according to a third embodiment of the present invention, which is largely similar to the air conditioning apparatus described previously with reference to FIG. 10, and like parts are assigned the same reference numerals. In this case elastic baffle sheets 71 are mounted between edges 64 of the evaporator 21 and condenser 20 and the outer side wall 40 of the conditioned air duct 4. These baffle sheets 71 simply stretch as the evaporator 21 and condenser 20 are moved into an out of the conditioned air duct 4.

It will be appreciated that many other arrangements of baffles are possible. For example in some cases the baffle may be of concertina-like construction to expand and collapse as the heat exchangers are moved between the ducts 4, 5.

Figure 12:
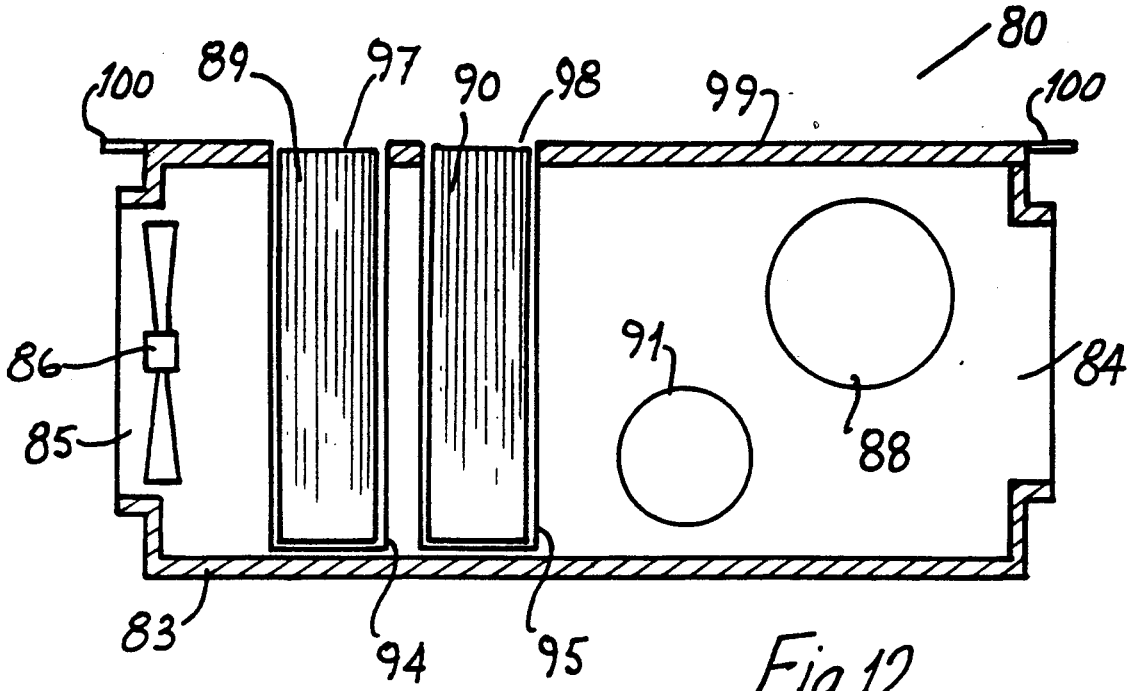
FIG. 12 is a diagrammatic sectional plan view of an air conditioning apparatus according to a fourth embodiment of the present invention.
Figure 13:
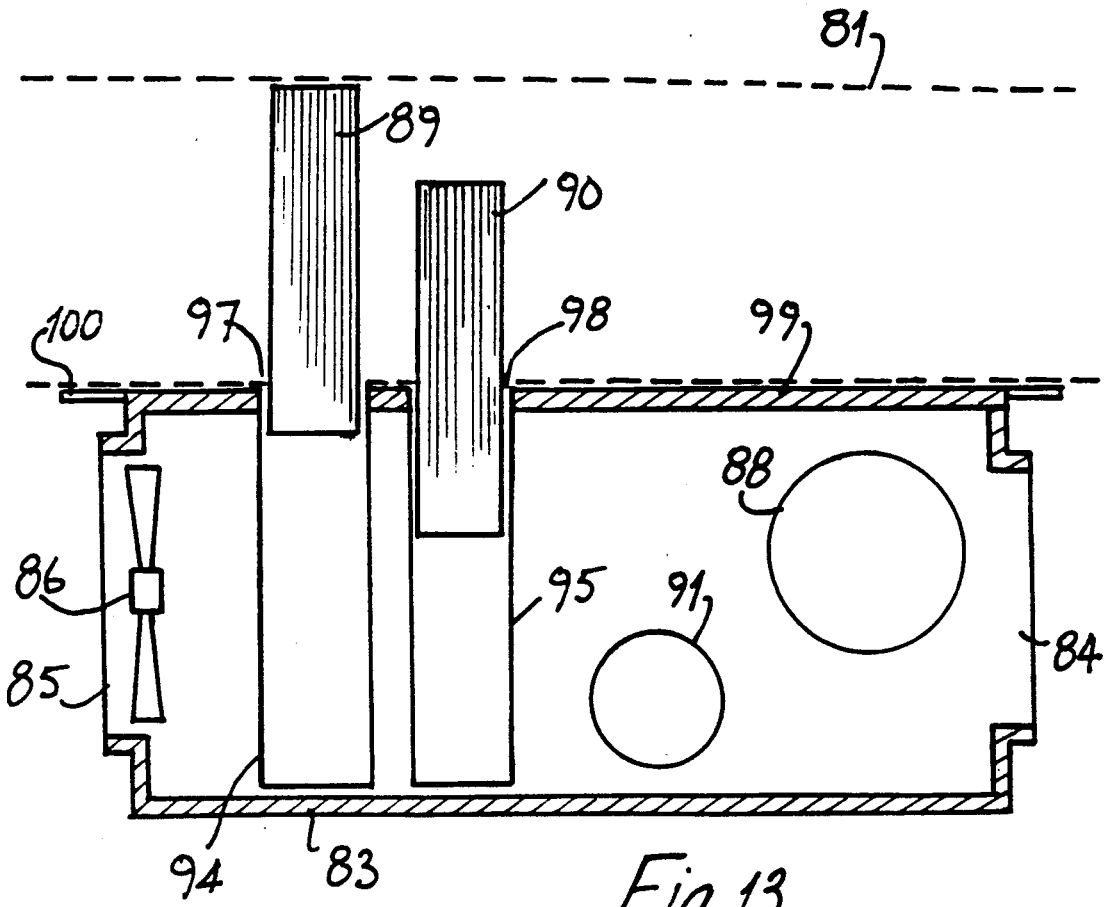
FIG. 13 is a diagrammatic sectional plan view of the apparatus of FIG. 12, in use.

Referring now to FIG. 12 and FIG. 13 there is illustrated an air conditioning apparatus 80 according to a fourth embodiment of the present invention, which is for mounting on an air duct 81 (shown in broken outline in FIG. 13) to condition air within the air duct 81. The apparatus 80 comprises an elongate housing 83 having an air inlet 84 at one end and an air outlet 85 at its other end. A fan 86 is mounted at the air outlet 85. A refrigeration unit is mounted within the housing 83 and comprises a compressor 88, a condenser 89, an evaporator 90 and a liquid refrigerant receiver 91. Both the condenser 89 and the evaporator 90 are slidably mounted on tracks 94, 95 and are extendable outwardly through openings 97, 98 in a side wall 99 of the housing 83. Mounting brackets 100 are provided on the side wall 99 for attachment of the apparatus 80 onto a side wall of the duct 81.

In use, the apparatus 80 is fixed onto a side wall of the duct 81, openings being provided in the duct 81 corresponding to the openings 97, 98 in the housing 83 of the apparatus 80. An air stream delivered through the duct 81 can then be conditioned as previously described with reference to the apparatus of FIGS. 1 to 9 by moving the condenser 89 and evaporator 90 into and out of the air stream delivered through the duct 81.

The air conditioning apparatus may be of any suitable materials of construction.

The invention is not limited to the embodiments hereinbefore described which may be varied in both construction and detail.

I claim:

1. An air conditioning apparatus comprising:

a pair of heat exchangers, one of said pair of heat exchangers being a heater and the other of said pair of heat exchangers being a cooler, means for adjustably mounting said heat exchangers adjacent an air stream path defined by a conditioned air duct having an air inlet and an air outlet, said air duct including a side wall with a pair of openings, each of said pair of heat exchangers being movable through one of said openings into and out of said duct between said air inlet and said air outlet, means for independently moving each heat exchanger between a position withdrawn from said air stream path through a partially inserted intermediate position in which a portion of said heat exchanger is located within said air stream path, and a fully inserted position, such that when both heat exchangers are within said air stream path said heater is downstream of said cooler, control means operatively associated with the means for moving each heat exchanger for regulating the position of each heat exchanger relative to said air stream path among any of a position withdrawn from the air stream path, a partially inserted position and a fully inserted position, the control means including means for sensing an air condition in said air stream path downstream of said heat exchangers to coordinate the positions of each of said heat exchangers among any of the positions of each of said heat exchangers among any of said positions to maintain air delivered through said air stream path at a pre-set desired air condition.

2. An apparatus in claim 1, wherein the apparatus includes a fan mounted in said conditioned air duct downstream of said heat exchangers for air delivery through the conditioned air duct.

3. An apparatus as recited in claim 1, wherein each of said pair of heat exchangers is movable substantially transversely to a direction of air flow along said air stream path.

4. An apparatus as recited in claim 1, wherein an air flow baffle is provided for each of said pair of heat exchangers, said baffle being extendable within said air stream path between said heat exchanger and a side wall of said air stream path to regulate air flow along said air stream path, said baffle and said heat exchanger having a substantially similar air flow resistance to promote an even air flow along said air stream path.

5. An apparatus as recited in claim 4, wherein said baffle is a flexible sheet wound on a rotationally biased roller, said sheet being extendable from said roller against roller bias between said heat exchanger and said side wall of said air stream path.

6. An apparatus as recited in claim 1, wherein means are included in said mounting means to deliver an air flow over at least portions of said pair of heat exchangers outside said air stream path.

7. An apparatus as recited in claim 6, wherein said delivery means is a housing which receives said pair of heat exchangers, said housing having an air inlet, an air outlet and a fan.

8. An apparatus as recited in claim 1, wherein each of said pair of heat exchangers includes a number of spaced-apart heat transfer fins, each of said fins forming a closure member for one of said openings in said duct side wall when said fin is located in said opening.

9. An apparatus as recited in claim 7, wherein said housing includes an ambient air duct mounted alongside and parallel to a conditioned air duct on a support frame, said ducts being separated by a common side wall and each of said ducts having an air inlet, an air outlet and a fan, and a refrigeration unit which is mounted in said ambient air duct and which includes a condenser and an evaporator which are movable between said ducts upstream of the fans, said side wall having openings therethrough for through passage of said condenser and said evaporator so that said evaporator and said condenser may move between said two ducts, each of said evaporator and said condenser includes a number of heat transfer fins, each of said fins forming a closure member for one of said openings in said side wall when said fin is located in said opening, sealing means being provided at each opening extending between a periphery of said opening and said heat exchanger.

10. An air conditioning apparatus comprising:

a pair of heat exchangers, one of said pair of heat exchangers being a heater and the other of said pair of heat exchangers being a cooler, means for adjustably mounting said heat exchangers adjacent an air stream path defined by a conditioned air duct having an air inlet and an air outlet, said air duct including a side wall with a pair of openings, each of said pair of heat exchangers being movable through one of said openings into and out of said duct between said air inlet and said air outlet, means for independently moving each heat exchanger between a position withdrawn from said air stream path through a partially inserted intermediate position in which a portion of said heat exchanger is located within said air stream path, and a fully inserted position, such that when both heat exchangers are within said air stream path said heater is downstream of said cooler, control means operatively associated with the means for moving each heat exchanger for regulating the position of each heat exchanger relative to said air stream path, the control means including means for sensing an air condition in said air stream path downstream of said heat exchangers to regulate the position of each heat exchanger to maintain air delivered through said air stream path at a pre-set desired air condition, and an air flow baffle provided for each of said pair of heat exchangers, said baffle being extendable within said air stream path between said heat exchanger and a side wall of said air stream path to regulate air flow along said air stream path, said baffle and said heat exchanger having a substantially similar air flow resistance to promote an even air flow along said air stream path, said baffle being a sheet of elastic material fixed to said heat exchanger and to said side wall.

11. An air conditioning apparatus comprising:

a pair of heat exchangers, one of said pair of heat exchangers being a heater and the other of said pair of heat exchangers being a cooler, means for adjustably mounting said heat exchangers adjacent an air stream path defined by a conditioned air duct having an air inlet and an air outlet, said air duct including a side wall with a pair of openings, each of said pair of heat exchangers being movable through one of said openings into and out of said duct between said air inlet and said air outlet, and an air flow baffle provided for each of said pair of heat exchangers, said baffle being extendable within said air stream path between said heat exchanger and a side wall of said air stream path to regulate air flow along said air stream path, said baffle and said heat exchanger having a substantially similar air flow resistance to promote an even air flow along said air stream path, said baffle being a sheet of elastic material fixed to said heat exchanger and to said side wall.

* * * * *